US006397434B1

(12) United States Patent
Cheal et al.

(10) Patent No.: US 6,397,434 B1
(45) Date of Patent: Jun. 4, 2002

(54) VEHICLE LID HINGE

(75) Inventors: Jonathan Paul Anthony Cheal, Staffordshire; Andrew Proffitt, Wolverhampton, both of (GB)

(73) Assignee: ITW Limited, Swansea (GB)

( * ) Notice: Subject to any disclaimer, the term of this patent is extended or adjusted under 35 U.S.C. 154(b) by 0 days.

(21) Appl. No.: 09/836,530

(22) Filed: Apr. 18, 2001

(30) Foreign Application Priority Data

Apr. 19, 2000 (GB) ..... 0011311

(51) Int. Cl.[7] ..... E05D 15/32; E05F 5/02

(52) U.S. Cl. ..... 16/370; 16/82; 16/289; 16/335; 16/371; 16/374

(58) Field of Search ..... 16/370, 335, 280, 16/281, 282, 284, 286–290; 296/76; 180/69.2, 69.21; 49/383, 384, 386, 379; 292/DIG. 14, DIG. 23, 60, 63; 312/319.2, 319.4, 323

(56) References Cited

U.S. PATENT DOCUMENTS 769,201 A * 9/1904 Blarcom et al. ..... 16/289
2,520,921 A * 9/1950 Foster ..... 16/285
2,656,563 A * 10/1953 Jones ..... 16/289
2,720,676 A * 10/1955 Vigmostad ..... 16/285
3,195,173 A * 7/1965 McNay et al. ..... 16/285
5,836,050 A * 11/1998 Rumez et al. ..... 16/84

FOREIGN PATENT DOCUMENTS

FR 2621064 * 9/1987

* cited by examiner

*Primary Examiner*—Chuck Y. Mah
(74) *Attorney, Agent, or Firm*—Lowe Hauptman Gilman & Berner, LLP

(57) ABSTRACT

A hinge for a vehicle lid comprises a main spring means (112) operable to urge the hinge into an open position, and a device (114) for assisting the initial opening of the hinge, the device comprising an elongate body in which a plunger (116) is sliceable, the plunger being engageable with the hinge, and spring means disposed in the body and acting on the plunger to urge it into an extended position. The plunger is cylindrical and is retained in a cylindrical cavity in the body by an annular fastening, the fastening being formed with one or more radially projecting ribs which engage with an annular recess at the opening of the cylindrical cavity to attach the fastening means to the body. The plunger is formed such that in the extended position disengagement of the one or more ribs from the annular recess is inhibited, preventing the plunger from forcing the fastening out of the body. A bracket extends from a wall of the body to define a slot between the member and the wall, enabling the device to be mounted upon a link of the hinge.

25 Claims, 6 Drawing Sheets

VEHICLE LID HINGE

FIELD OF THE INVENTION

This invention is concerned with a vehicle lid hinge having a main spring means operable to urge the hinge into an open position and a device for assisting the initial opening of the hinge, and to a device for use on such a hinge.

BACKGROUND TO THE INVENTION

Four-link hinges are often used on the boot lids of European cars because they intrude less into the boot space when the lid is closed, and enable the lid to be opened to a greater angle from its closed position than the more conventional hinge comprising a single curved link. Use of such four-link hinges on car boot lids increases the usable boot space and improves access thereto.

Four-link hinges in general comprise a gas strut connected between two of the links and operable to open the hinge by acting upon said two links. However, it has been found that the line of action of the gas strut is such that it acts to open the hinge only once the hinge is partially opened. This means that the boot lid initially seems to be excessively heavy to a person attempting to open it, and prevents the lid from being opened from inside the car using a remote catch, since the boot lid is held closed by its weight and locks again as soon as the remote catch is released.

Several arrangements have been proposed for opening the hinge to the point where the gas strut starts to act, including, in one arrangement a folded Ieaf spring attached to a first link and acting upon a second link, and in a second arrangement a cam pivotally attached to one of the links such that the gas strut initially acts upon the cam rather than the link itself to open the hinge.

Car manufacturers have been slow to accept either arrangement for a number of reasons, but principally because of their appearances, and their tendencies to distort the lid when in the closed position.

SUMMARY OF THE INVENTION

According to a first aspect of the present invention there is provided a hinge for a vehicle lid, the hinge comprising a main spring means, for example a gas strut, operable to urge the hinge into an open position, and a device for assisting the initial opening of the hinge, the device comprising an elongate body in which a plunger is slidable, the plunger being engageable with another portion of the hinge to provide said assistance, and spring means disposed in the body and acting on the plunger to urge it into an extended position.

Thus the invention provides a hinge for a vehicle lid having a device for assisting the initial opening of the hinge that is discrete in appearance and does not need elements that can distort the boot lid when the lid is in the closed position.

Preferably the hinge is a four-link hinge.

Preferably the hinge comprises a body link for attaching to a vehicle body, a lid link for attaching to a vehicle lid, short and long links joining the body and lid links, and the main spring means comprises a gas strut attached between the body and lid links, the device being attached to the long link such that the plunger acts upon the end of the gas strut attached to the lid link.

Alternatively the device may advantageously be attached to the long link such that the plunger acts directly upon the lid link.

The long link may advantageously be cranked or kinked to accommodate the device within the hinge without increasing the overall width of the hinge.

Preferably the plunger engages with the hinge only when the hinge is in a closed position and during the initial opening of the hinge from the closed position.

Preferably the plunger is retained in the body by a fastening means attached to the elongate body.

Preferably the elongate body has a cylindrical internal cavity having an opening to accommodate the plunger, the plunger being cylindrical and the fastening means being an annular fastening.

Preferably the elongate body is formed with an annular recess at the opening of the cylindrical internal cavity and the annular fastening is formed with one or more radially projecting ribs, which ribs engage with the annular recess.

According to a particularly advantageous feature of the invention the plunger may be so shaped that, when in the extended position, it exerts a radial outward force upon the annular fastening and forces the one or more radially projecting ribs into the annular recess to strengthen the attachment of the annular fastening to the elongate body.

The spring means may advantageously comprise a mechanical spring, preferably a helical compression spring.

Advantageously the spring means may be damped such that the plunger moves to the extended position at a controlled rate.

Preferably at least one of, and more preferably all of, the elongate body, plunger and annular fastening may be formed from rigid plastics material.

The rigid plastics material may advantageously be an acetal resin.

Preferably the device has a flexible member which is so positioned as to define a slot between the flexible member and a wall of the elongate body, thereby enabling the device to be mounted upon a first link of the hinge.

This feature enables the device to be fitted to the rest of the hinge after the latter has been assembled.

Typically the hinge is a hinge of a vehicle boot lid but may be, for example, the hinge of a vehicle bonnet.

Advantageously the elongate body may further comprise a stud which projects into said slot to engage with an aperture in said first link, such that said flexible member may be sufficiently deformed to enable the stud to pass over the thickness of the link until the stud engages with the aperture, thereby securing the device in position upon the link.

Alternatively the flexible member may advantageously comprise an aperture for receiving a pin, the aperture being located such that when the device is mounted upon said first link of the hinge, the aperture in the flexible member and an aperture in said first link are in line.

Preferably the wall of the elongate body on the opposite side of the slot from the flexible member and in line with said aperture is formed with a recess for receiving one end of the pin.

Preferably the aperture in the hinge link is greater in size than the aperture in the flexible member, and the pin is formed with radially projecting barbs, such that when the device is mounted upon the hinge link, the pin may be pushed into the aperture in the member until the barbs pass through the member, whereupon the barbs expand into the aperture in the link, thereby retaining the pin in the flexible member.

Preferably, the flexible member comprises a finger, which may, for example, comprise a bracket, having a connecting portion which connects the finger to the body and which extends perpendicularly to the body.

According to a second aspect of the invention there is provided a four-link hinge for a vehicle lid comprising a main spring means, for example a gas strut, operable against one of the links to urge the hinge into an open position, and a device for assisting the initial opening of the hinge, wherein the device comprises an elongate body in which a plunger is retained by an annular fastening attached to the elongate body, and spring means for urging the plunger into an extended position for engagement with the hinge.

According to a third aspect of the invention there is provided a device for use with a hinge in accordance with the first or second aspect of the invention, comprising an elongate body in which a plunger is sliceable, the plunger being engageable with the hinge, and spring means disposed in the body and acting on the plunger to urge it into an extended position.

BRIEF DESCRIPTION OF THE DRAWINGS

The invention will now be described, by way of example only, with reference to the accompanying drawings in which.

DESCRIPTION

Figure 1:
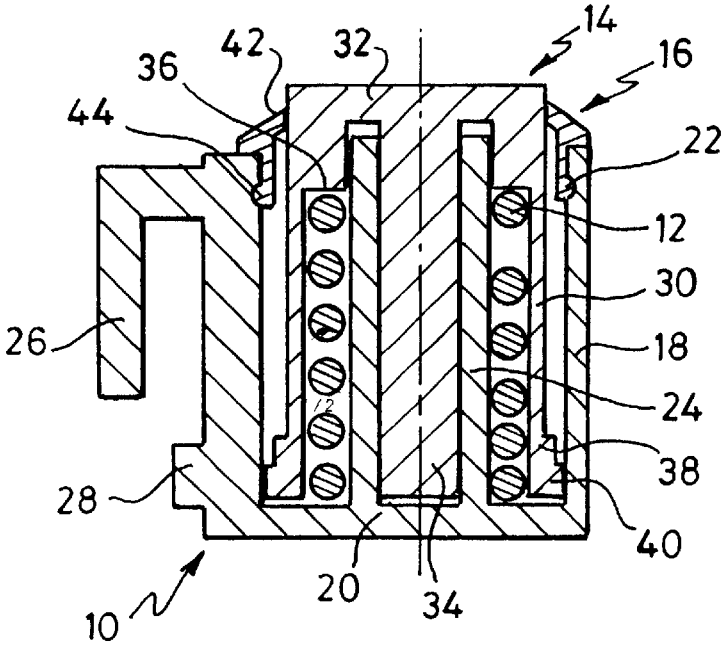
FIG. 1 is a section of a first embodiment of a spring device in accordance with the invention, the device being shown with its plunger in a retracted position.
Figure 2:
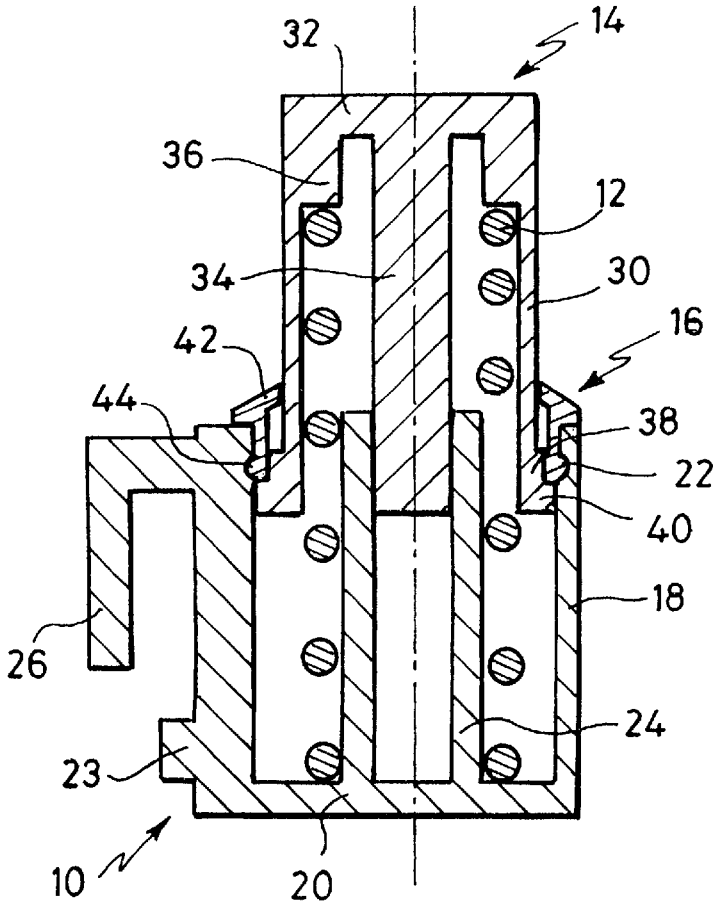
FIG. 2 is a section of the first embodiment of the spring device showing the plunger in an extended position.

FIGS. 1 and 2 show a first embodiment of the spring device having an elongate body 10, a helical compression spring 12, a plunger 14 and a fastening 16.

The elongate body 10 is generally cup-shaped, having a wall 18 which has four vertical external surfaces. The body has an open, upper end and a closed, lower end, the lower end being closed by a base 20. The internal surface of the wall 18 is generally cylindrical but has an annular recess 22 a short distance from the open end of the body. A guide 24 constituted by a tubular member extends from the centre of the internal surface of the base 20 to the open end of the body.

The internal surface of the wall 18 and the external surface of the guide 24 define, respectively, the outer and inner limits of an annular cavity in the body. The internal surface of the guide 24 is cylindrical and defines a cylindrical cavity in the body. The annular and cylindrical cavities are coaxial.

A flexible bracket 26 constituted by a right-angled member projects from near the top of one of the four vertical external surfaces of the wall 18 and extends parallel to, and for approximately two thirds of the length of, said surface, to define a slot between the surface and the bracket 26 which enables the spring device to be mounted upon a link of a hinge. A circular stud 28 projects from the centre of the lower end of the surface below the slot. Although not shown, the slot would normally be occupied by a link of a hinge, and the circular stud 28 would engage with an aperture in the link, thereby securing the spring device to the link.

To attach the spring device to the hinge link the flexible bracket 26 is deformed by bending it away from the wall of the body to enable the link to pass between the circular stud and the lower end of the bracket into the slot, until the stud engages with the aperture in the link, whereupon the bracket returns to its undeformed shape.

The wall 18, base 20, guide 24, bracket 26 and stud 28 are all integrally moulded as a single component.

The plunger 14 is generally cup-shaped, having a wall 30 with a cylindrical external surface. The plunger has an open, lower end and a closed, upper end, the upper end being closed by the plunger head 32. A cylindrical shaft 34 extends from the centre of the internal surface of the plunger head 32 to the open end of the plunger. The diameter of the shaft 34 is slightly less than the internal diameter of the guide 24. The internal surface of the wall 30 has a lower and an upper portion, the upper and lower portions being cylindrical and the diameter of the lower portion being greater than the diameter of the upper portion. The upper and lower portions are joined by a radial shoulder 36. The lower portion of the internal surface of the wall and the surface of the shaft 34 define the outer and inner limits, respectively, of a lower annular cavity in the plunger. The upper portion of the internal surface of the wall and the surface of the shaft 34 define the outer and inner limits, respectively, of an upper annular cavity in the plunger.

Contiguous upper and lower flanges 38 and 40 are formed at the lower end of the external surface of the wall 30 of the plunger. The external diameter of the upper flange 38 is less than that of the lower flange 40. The external diameter of the lower flange 40 is slightly less than the diameter of the internal surface of the wall 18 of the body 10.

The wall 30, plunger head 32, shaft 34, shoulder 36, upper flange 38 and lower flange 40 are integrally moulded as a single component.

The internal diameter of the spring 12 is slightly greater than the external diameter of the guide 24. The external diameter of the spring is slightly less than the diameter of the lower portion of the internal surface of the wall 30 of the plunger.

The fastening 16 is generally annular and has an internal and an external surface, each of which is generally cylindrical. An annular lip 42 extends inward from the upper end of the internal surface and an annular rib 44 projects radially outward from the lower end of the external surface. The internal diameter of the lip 42 is slightly greater than the external diameter of the plunger. The diameter of the internal surface of the fastening is slightly greater than the external diameter of the upper flange 38 but less than the external diameter of the lower flange 40. The external diameter of the rib 44 is greater than the diameter of the internal surface of the wall 18 of the body.

The spring device is assembled by inserting the upper end of the spring 12 into the lower annular cavity in the plunger until the upper end of the spring engages with the radial shoulder 36. The lower end of the spring, which protrudes from the open end of the plunger, is placed over the guide 24 and pressed towards the lower end of the body, until the lower end of the spring engages with the internal surface of the base 20. The plunger is depressed into the body, in opposition to the spring, which acts against the radial shoulder 36 and the base 20 of the body to urge the plunger out to the body, the shaft 34 being accommodated in the guide 24 and the guide being accommodated in the upper and lower annular cavities in the plunger.

The fastening is placed over the upper end of the plunger and, with the plunger depressed into the body in opposition to the spring, the lower end of the fastening is forced into the open end of the body. The external diameter of the rib 44 results in a slight radial compression of the fastening as it is forced into the open end of the body. The radial compression deforms the lower end of the fastening away from the internal surface of the wall 18 of the body and towards the external surface of the wall 30 of the plunger. When the fastening has been forced a sufficient distance into the open end of the body for the rib 44 and the recess 22 to be in alignment, the rib engages with the recess, enabling the fastening to expand radially to its undeformed shape. Slight radial compression of the fastening to disengage the rib from the recess is therefore necessary before the fastening can be removed from the body.

When the plunger is released from its depressed position, the spring urges the plunger towards the open end of the body, until the plunger reaches its extended position when the lower flange 40 of the plunger engages with the lower end of the fastening. With the lower flange 40 engaged with the lower end of the fastening, the upper flange 38 prevents radial compression of the fastening. Thus the plunger is prevented in its extended position from forcing the fastening out of body.

The lip 42 inhibits the ingress of dust and the like into the spring device.

The lip 42 and rib 44 are integrally moulded parts of the annular fastening.

The elongate body 10, cylindrical plunger 14 and annular fastening 16 are all moulded from an acetal resin.

In FIG. 1 the plunger 14 is shown in a retracted position relative to the elongate body 10 due to a force acting upon the plunger in opposition to the spring 12.

In FIG. 2 the plunger 14 is shown in an extended position relative to the elongate body 10. The further extension of the plunger due to the action of the spring 12 is prevented by the engagement of the lower flange 40 with the lower end of the annular fastening 16.

Figure 3:
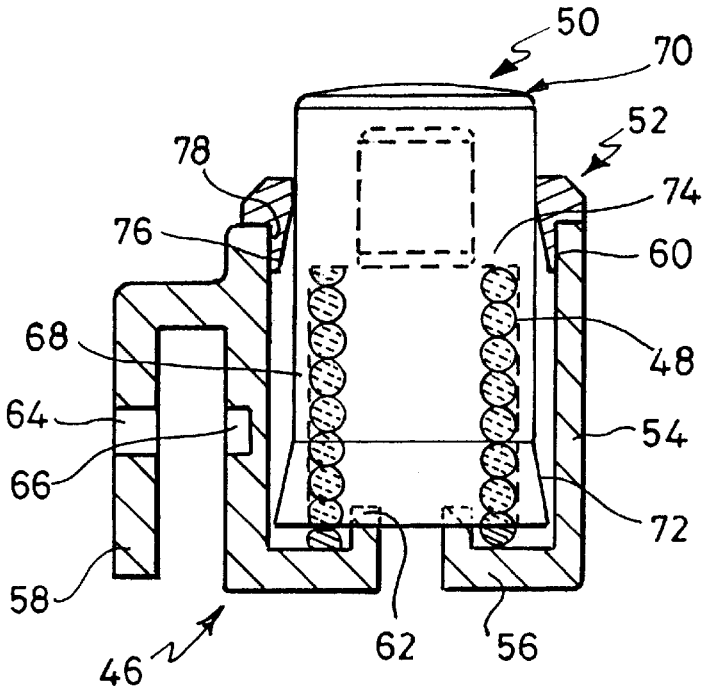
FIG. 3 is a section of a second embodiment of the spring device showing the plunger in a retracted position.
Figure 4:
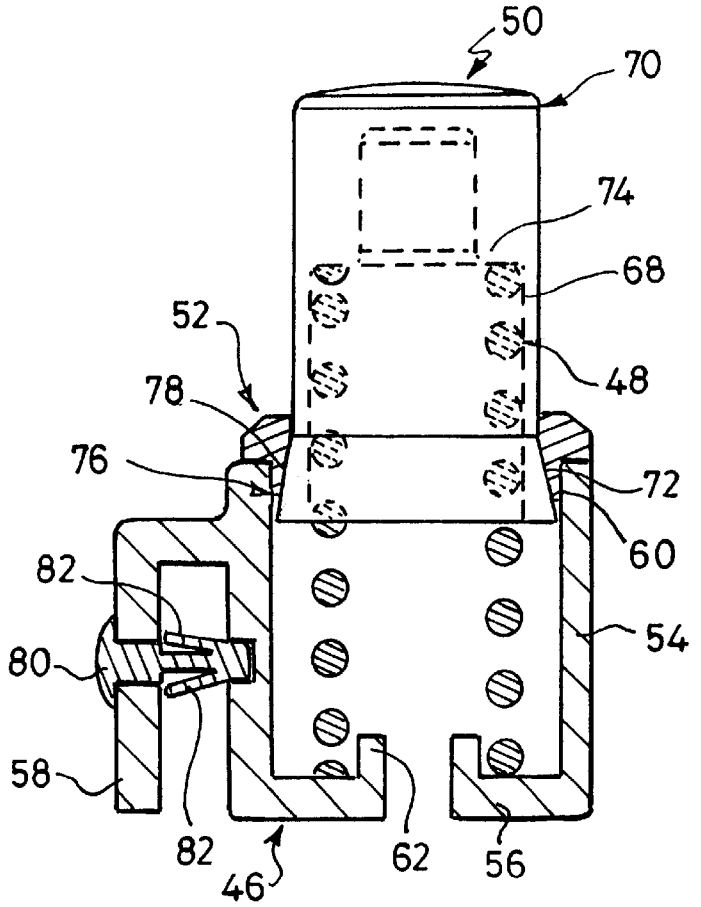
FIG. 4 is a section of the second embodiment of the spring device showing the plunger in an extended position.

FIGS. 3 and 4 show a second embodiment of the spring device comprising an elongate body 46, a helical compression spring 48, a plunger 50 and a fastening 52.

The elongate body 46 is of a broadly similar shape to the elongate body 10, having a wall 54 with four external surfaces, a base 56 and a bracket 58 constituted by a right-angled member which projects from one of the four external surfaces of the wall 54. The internal surface of the wall 54 is cylindrical but is formed with an annular recess 60 a short distance from the upper, open end of the body. The base 56 is formed with a circular aperture at its centre and an annular ridge 62 projects a short distance from the internal surface of the base around the aperture into the body. The internal surface of the wall, the annular ridge 62 and the circular aperture are coaxial.

The bracket 58 extends parallel to, and along the whole length of, the external surface of the wall from which it projects, so as to define a slot between the bracket and said external surface, which enables the spring device to be mounted upon a link of a hinge. The bracket 58 has a circular aperture 64 at its centre. A circular recess 66 is formed in the external surface, having the same diameter as, and in line with, the aperture 64.

The wall 54, base 56, bracket 58 and annular ridge 62 are all integrally moulded as a single component.

The plunger 50 is generally cup-shaped and cylindrical, having a wall 68 which is open at its lower end and closed at its upper end by the plunger head 70. The internal surface of the wall 68 defines a lower cylindrical cavity in the plunger. The lower end of the external surface of the wall 68 is formed with a frusto-conical skirt 72, which tapers outwards in the direction of the lower end of the plunger. The diameter of the skirt 72 at its widest point is slightly less than the diameter of the internal surface of the wall of the body. The internal surface of the wall 68 has a lower and an upper portion, the lower and upper portions being cylindrical and the diameter of the of the lower portion being greater than the diameter of the upper portion. The upper and lower portions are joined by a radial shoulder 74. The upper and lower portions, respectively, of the internal surface of the wall define upper and lower cylindrical cavities in the plunger.

The wall 68, plunger head 70, skirt 72 and shoulder 74 are all integrally moulded as a single component.

The internal diameter of the spring 48 is slightly greater than the external diameter of the the annular ridge 62. The external diameter of the spring is slightly less than the diameter of the lower portion of the internal surface of the wall 68 of the plunger.

The fastening 52 is generally annular and has an inner and an outer surface, each of which is generally cylindrical. An annular rib 76 projects radially outward from the lower end of the external surface. The diameter of the internal surface of the fastening is slightly greater than the external diameter of the plunger. The internal surface of the lower end of the fastening has a frusto-conical portion 78 which tapers outwards in the direction of the lower end of the fastening. The diameter of the frusto-conical portion 78 of the internal surface of the fastening at its widest point is slightly less than the diameter of the skirt 72 at its widest point. The external diameter of the rib 76 is greater than the diameter of the internal surface of the wall 54 of the body.

The manner of assembly of the second embodiment of the spring device is broadly similar to that of the first embodiment described in relation to FIGS. 1 and 2. The upper end of the spring 48 is inserted into the lower cylindrical cavity in the plunger until the upper end of the spring engages with the radial shoulder 74. The lower end of the spring, which protrudes from the open end of the plunger, is inserted into the open end of the body and pressed towards the lower end of the body, until the lower end of the spring passes over the annular ridge 62 and engages with the internal surface of the base 56. The plunger is depressed into the body, in opposition to the spring, which acts against the radial shoulder 74 and the base 56 of the body to urge the plunger out to the body.

The fastening is placed over the upper end of the plunger and, with the plunger depressed into the body in opposition to the spring, the lower end of the fastening is forced into the open end of the body. The external diameter of the rib 44 results in a slight radial compression of the fastening as it is forced into the open end of the body. The radial compression deforms the lower end of the fastening away from the internal surface of the wall 54 of the body and towards the external surface of the wall 68 of the plunger. When the fastening has been forced a sufficient distance into the open end of the body for the rib 76 and the recess 60 to be in alignment, the rib engages with the recess, enabling the fastening to expand radially to its undeformed shape. Slight radial compression of the fastening to disengage the rib from the recess is therefore necessary before the fastening can be removed from the body.

When the plunger is released from its depressed position, the spring urges the plunger towards the open end of the body, until the plunger reaches its extended position when the frusto-conical skirt 72 of the plunger engages with the frusto-conical portion 78 of the internal surface of the lower end of the fastening. The engagement of the skirt 72 with the internal surface of the fastening exerts a radial outward force on the lower end of the fastening which strengthens the engagement of the rib 76 with the recess 60. Thus the plunger is prevented in its extended position from forcing the fastening out of body.

In FIG. 3 the plunger 50 is shown in a retracted position relative to the elongate body 46 due to a force acting upon the plunger head in opposition to spring 48.

In FIG. 4 the plunger 50 is shown in an extended position relative to the elongate body 46. The further extension of the plunger due to the action of the spring 48 is prevented by the engagement of the frusto-conical skirt 72 with the frusto-conical portion 78 of the fastening.

In FIG. 4 a pin 80 is shown pushed into the circular aperture 64 and circular recess 66 of FIG. 3. The pin is formed with two deformable barbs 82 which close as the pin is pushed into the hole 64, then open into the slot between the bracket 58 and the external surface of the wall 54, to prevent the removal of the pin. Although not shown, the slot would normally be occupied by a link of a hinge, and the pin would pass through an aperture in the link, the aperture having a greater diameter than the circular aperture 64 in order to enable the barbs 82 to open, thereby securing the spring device to the link.

Figure 5:
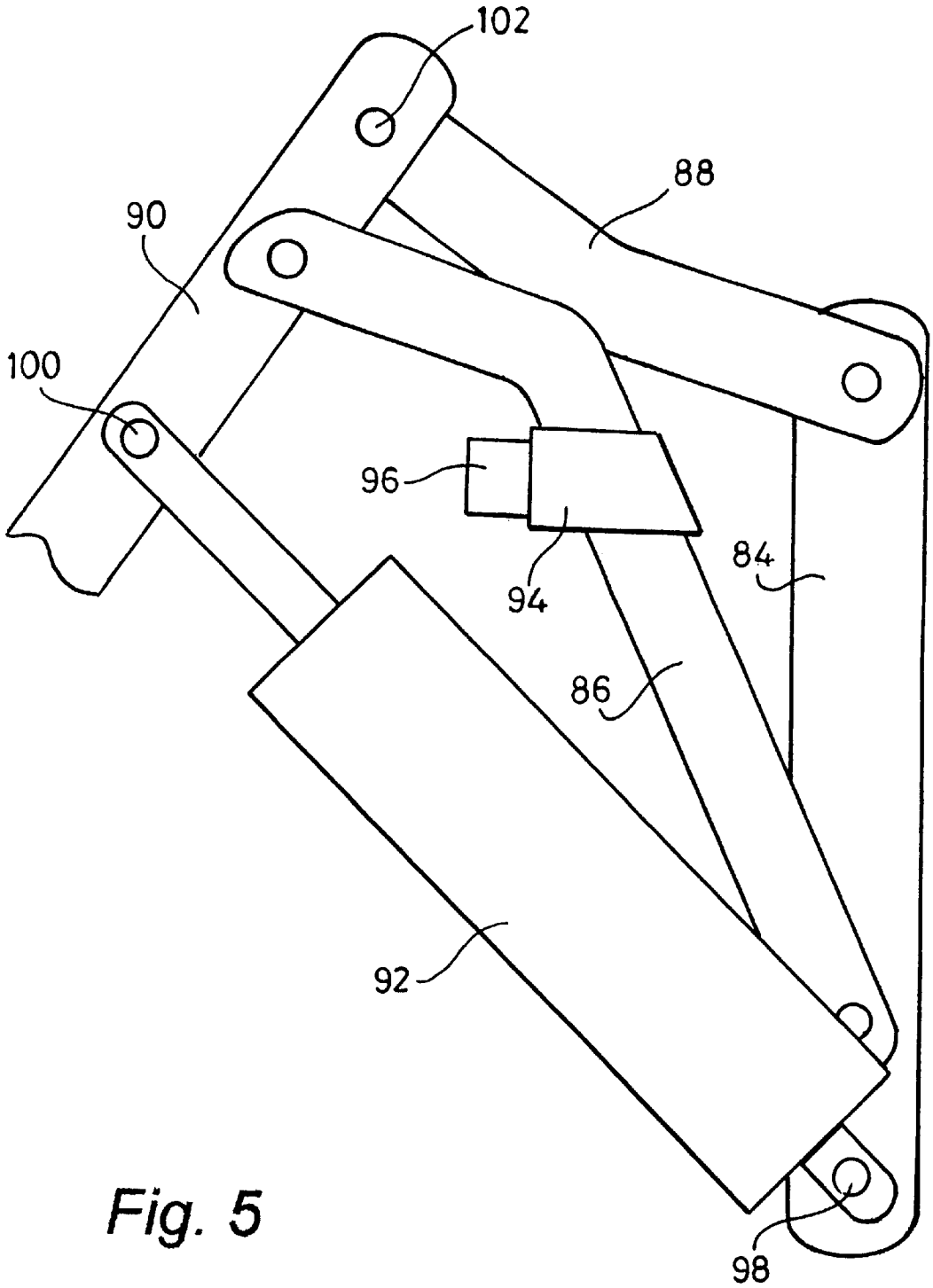
FIG. 5 is a side view of a first embodiment of a four-link hinge in accordance with the invention, the hinge being shown in its open position.
Figure 6:
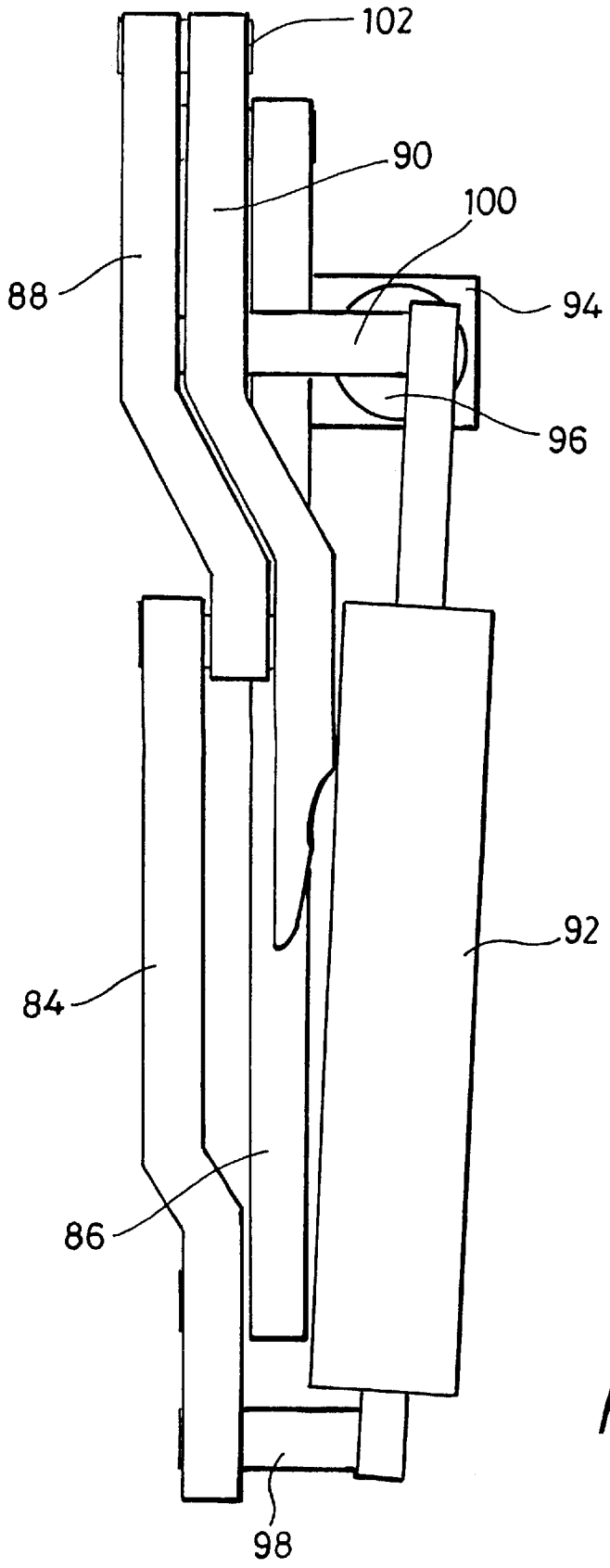
FIG. 6 is a plan view of the first embodiment of the four-link hinge when closed.

With reference to FIGS. 5 and 6, either embodiment of the spring device is attached in use to a first embodiment of a four-link hinge comprising a body link 84 attachable to the body of a vehicle, a long link 86, a short link 88, a lid link 90 attachable to the vehicle lid, a gas strut 92 and the spring device 94 including a plunger 96. For the purpose of simplicity, the vehicle lid and body have not been shown.

The construction and operation of the first embodiment of the four-link hinge are described with reference to FIGS. 5 and 6.

The long and short links 86 and 88 respectively are attached by pivots at their first ends to the body link 84 and at their second ends to the lid link 90. The gas strut 56 is attached by a pivot 98 at its first end to the body link 84 and by a pivot 100 at its second end to the lid link 90. The spring device 94 is mounted upon the long link 86 such that when the hinge is closed, the plunger 96 of the spring device 94 is depressed by the gas strut pivot 100.

When the hinge is closed the body link 84, lid link 90 and gas strut 92 are substantially parallel. The initial opening of the hinge comprises, inter alia, a rotation of the lid link 90 relative to the body link 84 about the pivot 102 which attaches the lid link 90 to the short link 88. The component of the force produced by the gas strut acting on pivots 98 and 100 to rotate the lid link 90 about pivot 102 relative to the body link 84 is, to a reasonable approximation, proportional to the sine of the angle between the lid and body links. Thus when the hinge is closed, the angle between the lid and body links is small and the sine of this angle, and hence the component of the force produced by the gas strut which tends to open the hinge, is vanishingly small.

The plunger 96 of the spring device is depressed by the gas strut pivot 100 when the hinge is closed, which compresses the compression spring (not shown) in the spring device. When the lid is unlatched, the force exerted by the compression spring on the plunger 96 causes the plunger to act against the gas strut pivot 100. The force exerted by the plunger on the pivot 100 gives rise to an opening torque about pivot 98. The geometry of the hinge is such that this is greater than the closing torque created by the reaction force exerted by the device 94 on the link 86. The plunger 96 thus rotates the lid link 90 upwards relative to the body link 84 about the pivot 102. As the angle between the lid and body links increases due to the action of the spring device, the component of the force exerted by the gas strut which tends to rotate the lid and body links relative to one another increases. By the time the plunger reaches its extended position and ceases to exert any force on the gas strut pivot 100, the component of the force exerted by the gas strut which tends to rotate the lid and body links relative to one another is sufficient to prevent the hinge from returning to the closed position.

Figure 7:
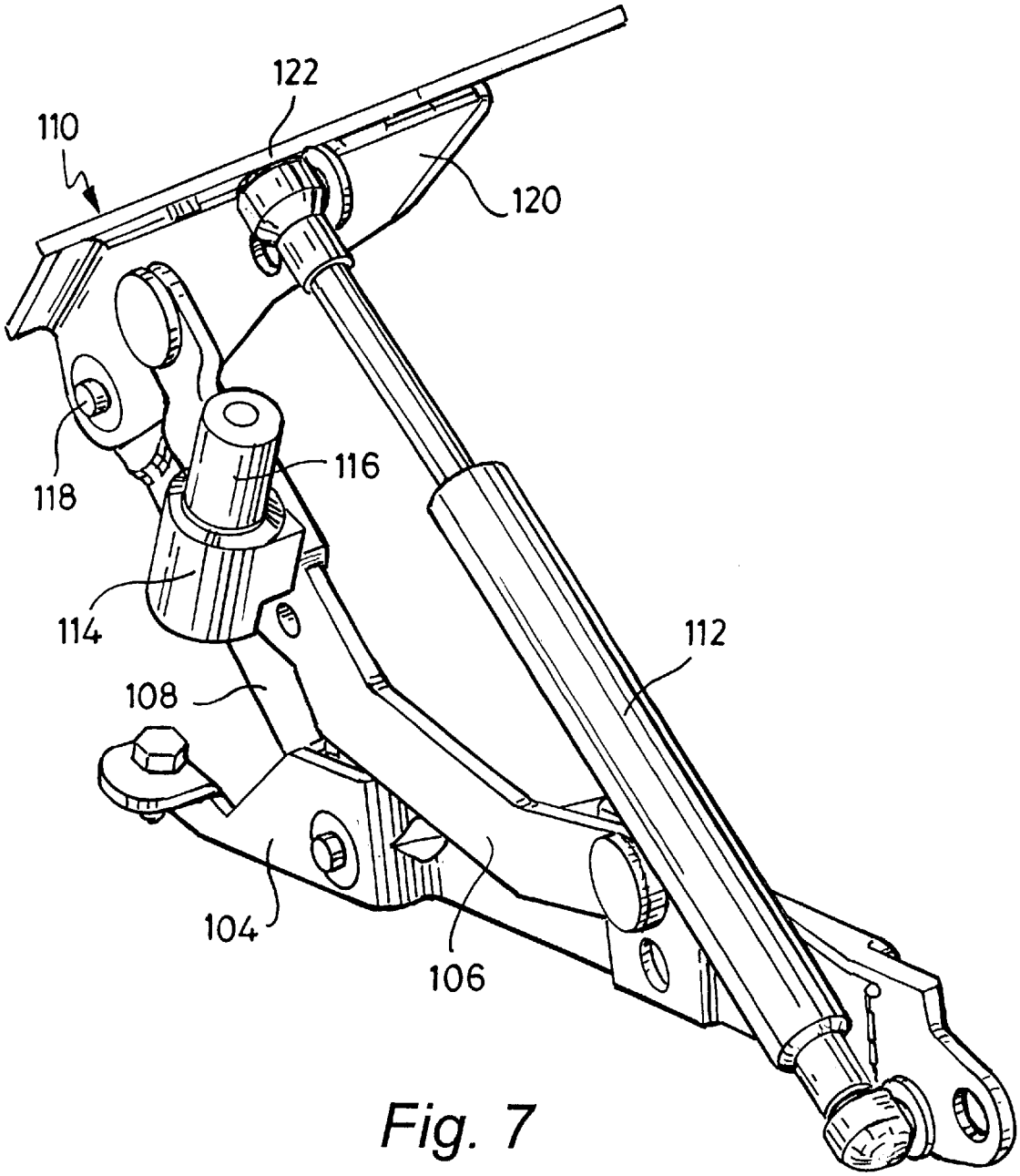
FIG. 7 is a perspective view of a second embodiment of a four-link hinge incorporating a spring device, the hinge being shown in its open position.
Figure 8:
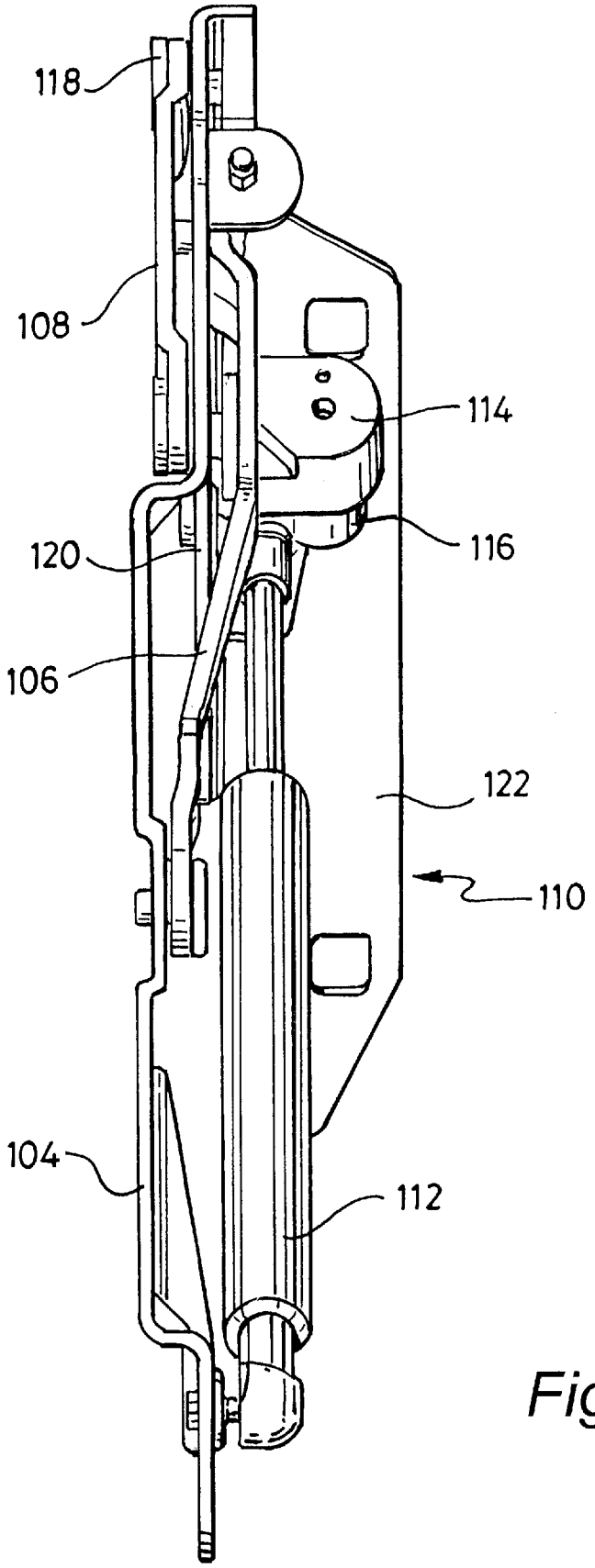
FIG. 8 is a perspective view of the second embodiment of the four-link hinge when closed.

With reference to FIGS. 7 and 8, either embodiment of the spring device is attached in use to a first embodiment of a four-link hinge comprising a body link 104 attachable to the body of a vehicle, a long link 106, a short link 108, a lid link 110 attachable to the vehicle lid, a gas strut 112 and the spring device 114 including a plunger 116. For the purpose of simplicity, the vehicle lid and body have not been shown.

The construction and operation of the four-link hinge are described with reference to FIGS. 7 and 8.

The construction and operation of the hinge shown in FIGS. 7 and 8 are broadly similar to those of the hinge shown in FIGS. 5 and 6. The lid link 110 has horizontal and vertical portions 120 and 122 respectively. The spring device 114 is mounted on the long link 104 such that when the hinge is closed, the plunger 116 of the spring device is depressed by the horizontal portion 120 of the lid link. In this embodiment of the hinge the spring device is located closer to the pivot 118 about which the lid link 110 rotates relative to the body link 104, than the spring device in the first embodiment is located to the corresponding pivot 102. Therefore, a spring device in the second embodiment produces a moment about the pivot 118 that is smaller than the moment that would be produced about the corresponding pivot 102 by the same spring device in the first embodiment. However the angle through which the lid link of the second embodiment rotates relative to the body link before the plunger ceases to exert a force on the lid link is correspondingly greater in the second embodiment than in the first.

What is claimed is:

1. A hinge mechanism for a vehicle lid, comprising:

a hinge, said hinge comprising a plurality of links pivotably connecting the vehicle lid to a vehicle body, said links comprising a main compressive link pivotably attached to the vehicle lid and the vehicle body and extendable to pivot the vehicle lid away from the vehicle body into an open state; and a spring device for initially moving the vehicle lid from a closed state, said spring device comprising a body fixed to one of said links of said hinge;

a plunger slidably attached to said body and engageable with another of said links of said hinge; and a spring element disposed between the body and the plunger and acting on the plunger to urge the plunger into an extended position, thereby forcing said one link away from said another link and causing the vehicle lid to initially move from the closed state toward the open state.

2. The hinge mechanism according to claim 1, wherein said links further comprise a body link attached to the vehicle body, a lid link attached to the vehicle lid, short and long links pivotably joined to the body and lid links to constitute a four-link arrangement.

3. The hinge mechanism according to claim 2, wherein the main compressive link comprises a gas strut pivotably attached between the body and lid links, the body is fixed to the long link such that the plunger acts upon the end of the gas strut attached to the lid link.

4. The hinge mechanism according to claim 3, wherein the long link is cranked or kinked.

5. The hinge mechanism according to claim 2, wherein the plunger is retained by an annular fastening member attached to the body.

6. The hinge mechanism according to claim 1, wherein the plunger engages with said another link when said hinge is in the closed position, and the plunger ceases to be engaged with said another link after said plunger has reached the extended position.

7. The hinge mechanism according to claim 1, wherein the plunger is retained by a fastening member attached to the body.

8. The hinge mechanism according to claim 7, wherein the body has a cylindrical internal cavity having an opening to accommodate the plunger, the plunger being cylindrical and the fastening member being an annular fastening.

9. The hinge mechanism according to claim 8, wherein the body is formed with an annular recess at the opening of the cylindrical internal cavity and the annular fastening is formed with one or more radially projecting ribs, which one or more ribs engages with die annular recess.

10. The hinge mechanism according to claim 9, wherein the plunger is formed such that in the extended position it exerts a radial outward force upon the annular fastening and forces the one or more radially projecting ribs into the annular recess to strengthen the attachment of the annular fastening to the body.

11. The hinge mechanism according to claim 7, wherein at least one of the body, the plunger and the fastening member is formed from rigid plastics material.

12. The hinge mechanism according to claim 11, wherein the rigid plastics material is an acetal resin.

13. The hinge mechanism according to claim 1, wherein the spring element comprises a mechanical spring.

14. The hinge mechanism according to claim 13, wherein the spring element comprises a helical compression spring.

15. The hinge mechanism according to claim 1, wherein the spring element is damped such that the plunger moves to the extended position at a controlled rate.

16. The hinge mechanism according to claim 1, wherein the body comprises a flexible angled member which extends from an external wall of the body to define a slot between a portion of the flexible angled member and said wall, thereby enabling the body to be mounted upon said one link of said hinge.

17. The hinge mechanism according to claim 16, wherein the body further comprises a stud which projects into said slot to engage with an aperture in said one link, said flexible angled member being sufficiently deformable to enable the stud to pass over a thickness of said one link until the stud engages with the aperture, thereby securing die body of the spring device in position upon said one link.

18. The hinge mechanism according to claim 1, wherein a force exerted by said main compressive link on the vehicle lid in the closed state is insufficient to initially move the vehicle lid from the closed state.

19. The hinge mechanism according to claim 1, wherein after the plunger has reached the extended position, a force exerted by said main compressive link on the vehicle lid is sufficient to continue moving the vehicle lid to the open state.

20. A spring device for assisting a hinge for the vehicle lid in the initial opening of the vehicle lid, the hinge comprising at least two links movable with respect to each other, said spring device comprising:

a body adapted to be fixed to one of the at least two links;

a plunger slidably attached to said body and engageable with another of the at least two links when the vehicle lid is in a closed state; and a spring element disposed between said body and said plunger and acting on said plunger to urge said plunger into an extended position, thereby forcing the at least two links away from each other and causing the vehicle lid to initially move from the closed state toward an open state.

21. The spring device according to claim 20, further comprising a fastening member attached to said body and forming a stop for said plunger when said plunger assumes the extended position.

22. The spring device according to claim 21, wherein said body has a recess on a wall thereof, and said fastener member has a rib snap-fitted in the recess, thereby ensuring the attachment of said fastener member and said body.

23. The spring device according to claim 22, wherein when said plunger assumes the extended position, a wall of said plunger stops adjacent to the rib so that the rib is sandwiched between the wall of said plunger and the recess to preclude disengagement of the rib from the recess.

24. The spring device according to claim 23, wherein the wall of said plunger and a wall of the fastener member opposite the rib are slanted to form a wedging arrangement such that, when said plunger assumes the extended position, a urging force exerted on said plunger by said spring element causing the rib to be pressed into the recess.

25. The spring device according to claim 22, wherein the rib is formed in a lower portion of said fastener member, the lower portion having a lower end face against which a lower flange of said plunger comes into abutment when said plunger assumes the extended position.

* * * * *